United States Patent [19]

Gill et al.

[11] 4,203,301

[45] May 20, 1980

[54] CONTROL CIRCUIT FOR REFRIGERATOR FAN

[75] Inventors: Harnek S. Gill, Huntsville; Charles R. Turner, Decatur, both of Ala.

[73] Assignee: Schaefer Corporation, Madison, Ala.

[21] Appl. No.: 12,617

[22] Filed: Feb. 16, 1979

[51] Int. Cl.[2] ..... F25D 17/06; F25B 49/00

[52] U.S. Cl. ..... 62/131; 62/158; 62/419

[58] Field of Search ..... 62/131, 419, 426, 158; 200/61.69, 61.7; 126/21 A

[56] References Cited

U.S. PATENT DOCUMENTS

| | | | |
|---|---|---|---|
| 3,090,209 | 5/1963 | Hubacker | 62/180 |
| 3,881,077 | 4/1975 | Piber | 200/61.69 |

*Primary Examiner*—William E. Wayner

*Attorney, Agent, or Firm*—George R. Clark; Neil M. Rose; Allen J. Hoover

[57] ABSTRACT

In a refrigerator comprising a cabinet, means to refrigerate contents of a chamber within the cabinet, a door for access to such chamber, a fan to circulate air within such chamber, and a switch operable with the door to a first mode wherein the switch enables the fan when the door is closed and to a second mode wherein the switch disables the fan when the door is opened, a relay having contacts arranged to be closed after a delay of preset duration from energization of the relay and to be opened upon deenergization of the relay is connected so as to be energized in the second mode of said switch, so as to be deenergized in the first mode of the switch, and so as to enable the fan when the contacts are closed. A lamp indicates that the contacts are closed.

8 Claims, 6 Drawing Figures

FIG. 1
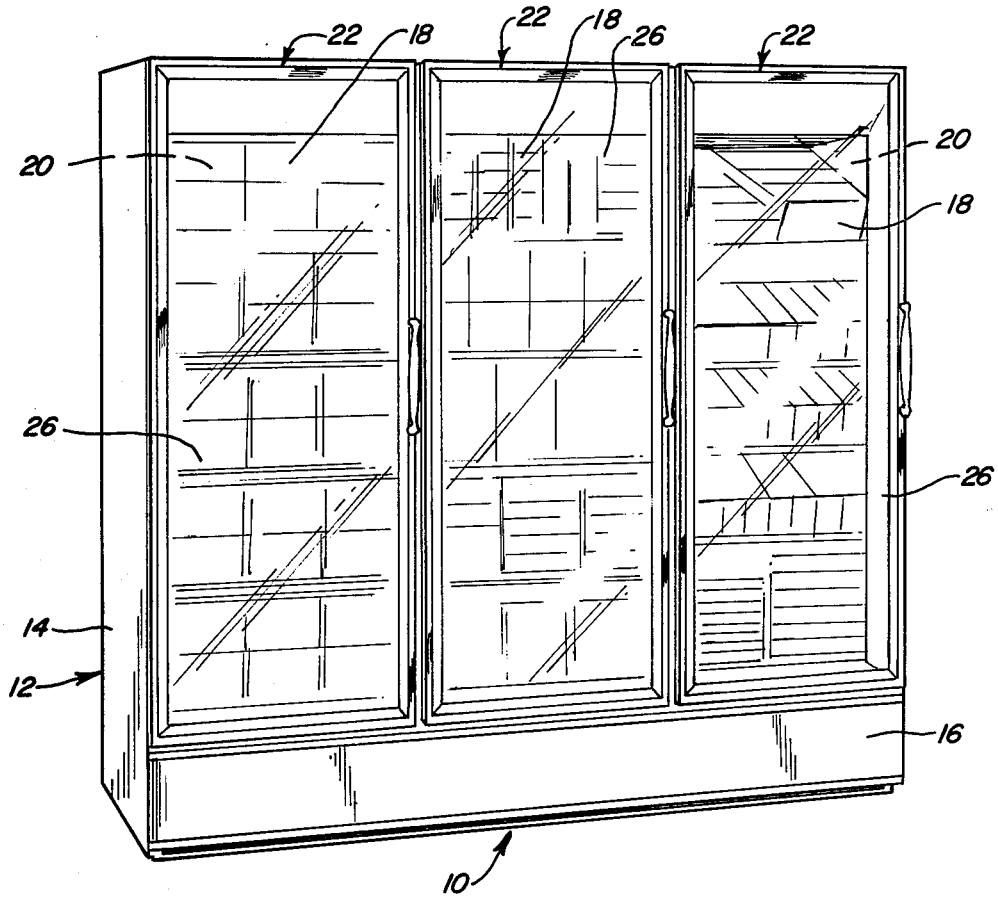
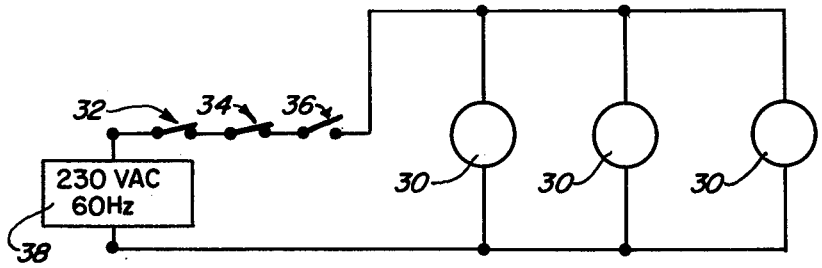
FIG. 2 PRIOR ART

CONTROL CIRCUIT FOR REFRIGERATOR FAN

BACKGROUND OF THE INVENTION

1. Field of the Invention

This invention pertains to a refrigerator of a type wherein a fan forces air to circulate within a chamber containing refrigerated contents, and wherein a switch is arranged to disable the fan when a door of the refrigerator is opened, particularly but not exclusively a freezer or other refrigerator as may be used to merchandise frozen foods, dairy products, and other products.

2. Description of Prior Art

It is conventional for a refrigerator of the type noted above to comprise a cabinet, means to refrigerate contents of a chamber within the cabinet, one or more doors for access to the chamber, and one or more fans to force air to circulate within the chamber so as to evaporate excess moisture within the chamber, and so as to eliminate stagnant regions within the chamber.

It is conventional for a switch to be mounted for operation with each door so as to switch to a first mode when such door is closed in normal operation, and so as to switch to a second mode when such door is opened in normal operation, and for the switch in its first mode to enable the fans to be energized and in its second mode to disable the fans.

It is conventional for several switches to be connected in series, so as to disable the fans whenever any one of the switches is in its first mode. Each switch may be a conventional switch having a plunger or similar means to switch the switch to its first mode whenever the plunger or similar means is depressed, as by closure of a door, and having a spring to bias the plunger oppositely so as to switch the switch to its second mode whenever the plunger or similar means is released.

It is desirable for the fans to be disabled when a door of the refrigerator is opened so as to minimize infiltration of ambient air. However, particularly but not exclusively in commercial freezers, dairy cases, and other refrigerators as may be used to merchandise frozen foods, dairy products, or other products, certain shortcomings have been ascertained in prior arrangements of one or more switches to disable one or more fans as discussed above.

Specifically, and particularly after many cycles as may be expected to occur in commercial freezers and other refrigerators used to merchandise various products, a switch mounted for operation with a door as discussed above may fail so as to remain in its second mode whether the door is opened or closed, whereupon the fans may remain disabled whether the door is opened or closed. Consequently, undue rise in interior temperature may result from inadequate circulation of air, and undue loads may be placed on a compressor and other components of the refrigerator.

Thus, there remains a need for improvement in a refigerator of the type noted above, particularly but not exclusively in commercial freezers, dairy cases, and other refrigerators as may be used to merchandise frozen foods, dairy products, and other products, wherein many cycles of such switches associated with such doors may be expected to occur.

SUMMARY OF THE INVENTION

An improvement according to this invention may be embodied in a refrigerator of the type comprising a cabinet, means to refrigerate contents of a chamber within the cabinet, a door mounted to the cabinet for access to the chamber, a fan disposed in the cabinet and operable to force air to circulate within the chamber, and a switch mounted for operation with the door so as to switch to a first mode wherein the switch enables the fan when the door is closed in normal operation, and so as to switch to a second mode wherein the switch disables the fan when the door is opened in normal operation.

By the improvement according to this invention, a relay, of a type having a set of contacts arranged to be closed after a delay of preset duration from energization of the relay, is connected so as to be energized in the second mode of the switch, so as to be deenergized in the first mode of the switch, and so as to enable the fan whenever the contacts are closed. A lamp may be connected so as to indicate that the contacts are closed.

The improvement according to this invention may be embodied in a refrigerator in which a plurality of such doors are mounted to the cabinet for access to the chamber within the cabinet, and in which a plurality of such switches are mounted for operation of at least one of the switches with each of the doors, wherein the relay is connected so as to be energized when any one of the switches is switched from its first mode to its second mode and so as to be deenergized when each one of the switches is switched from its second mode to its first mode. In the refrigerator, a plurality of such fans may be disposed in the cabinet, operable together and connected so as to be enabled together when the contacts of the relay are closed.

This invention has particular utility but not exclusive utility in commercial freezers, dairy cases, and other refrigerators as may be used to merchandise frozen foods, dairy products, and other products, and in other refrigerators wherein many cycles of such switches associated with such doors may occur. A delay of about three minutes may be appropriate, in commercial freezers, dairy cases, and other refrigerators, so as to allow sufficient time for customers to remove products to be purchased.

BRIEF DESCRIPTION OF THE DRAWINGS

FIG. 1 is a perspective view of a commercial refrigerator of a type which is used to merchandise frozen foods, dairy products, and other products, and in which this invention may be embodied.

FIG. 2 is a schematic diagram of a conventional arrangement of door switches and evaporator fans for such a refrigerator.

DETAILED DESCRIPTION OF THE PREFERRED EMBODIMENTS

Figure 3:
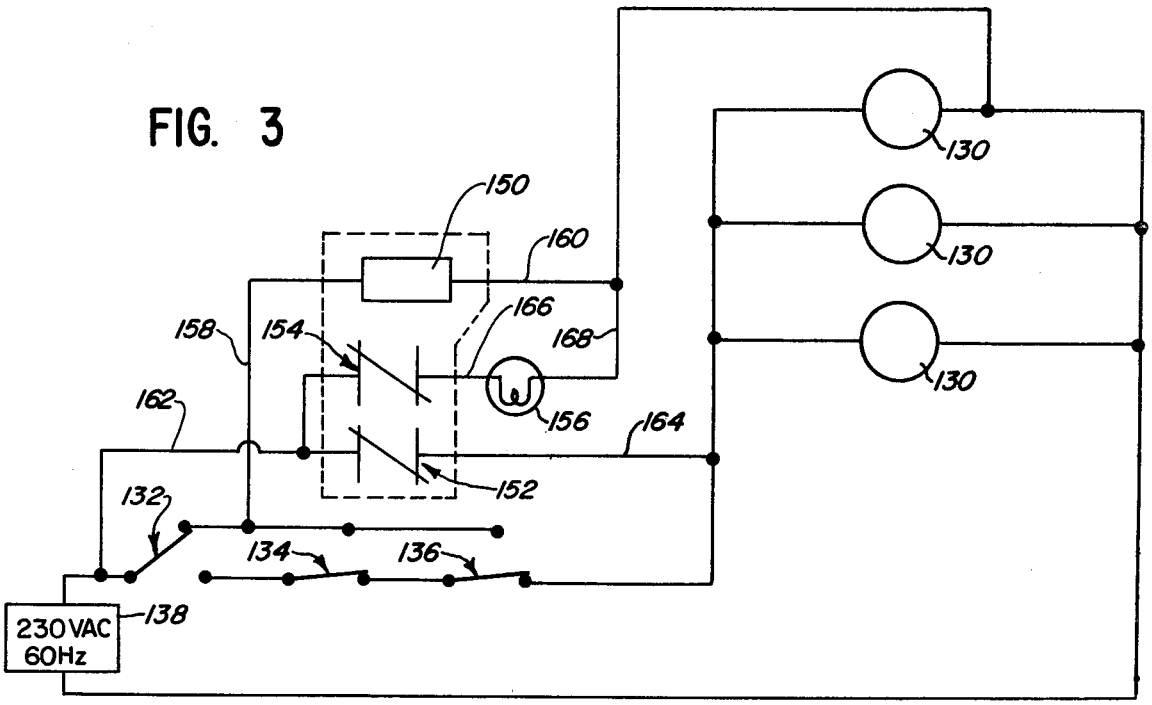
FIG. 3 is a schematic diagram of a referred embodiment of this invention as may be embodied in a refrigerator as shown in FIG. 1.

In the drawings, FIG. 1 shows a refrigerator 10 which may be used to merchandise frozen foods, dairy products, and other products, and in which this invention may be embodied. Conventionally, the refrigerator 10 comprises a cabinet 12, which has insulated top, bottom, back, and side walls, one side wall 14 being shown, and which has a base 16 enclosing suitable means (not shown) to refrigerate frozen foods, dairy products, or other contents 18 of a chamber 20 within the cabinet 12 to low temperatures, either above or below 0° C. as may be appropriate for refrigerated storage of various products.

Conventionally, the refrigerator 10 has three doors 22, which are hinged to appropriate framework 24 of the cabinet 12, which permit ready access to the contents 18 of the chamber 20, and which have transparent glass panels 26 permitting the contents 18 to be viewed while the doors 22 are closed. The panels 26 may have multiple panes, an outermost of which may be heated in conventional manner, so as to minimize external condensation on the panels 26.

As shown diagrammatically in FIG. 2, it is conventional for the refrigerator 10 to have a plurality of electrical fans 30 disposed in the cabinet 12 and operable to force air to circulate within the chamber 20 so as to evaporate excess moisture within the chamber 20, and so as to eliminate stagnant regions within the chamber 20. The fans 30, which may be called evaporator fans, are connected in parallel (as shown).

As also shown diagrammatically in FIG. 2, it is conventional for several switches 32, 34, and 36 to be mounted for operation of one such switch with each door 22 so as to switch to a first mode (as the switches 32 and 34 are shown) when such door 22 is closed, and so as to switch to a second mode (as the switch 36 shown) when such door 22 is opened, and for the switches 32, 34, and 36 to be connected so as to enable the fans 30 when each one of the switches 32, 34, and 36 is in its first mode, and so as to disable the fans 30 when any one of the switches 32, 34, and 36 is in its second mode. The switches 32, 34, and 36, which may be called door switches, are connected in series (as shown) between the fans 30 and a conventional source 38 of electrical power (230 VAC, 60 Hz, as shown).

Conventionally, each switch 32, 34, or 36 may have a plunger (not shown) switching such switch 32 from its second mode to its first mode when the plunger is depressed, as when the door 22 associated with such switch 32, 34, or 36 is closed, in normal operation, and a spring (not shown) biasing the plunger oppositely so as to switch such switch 32, 34, or 36 from its first mode to its second mode when the plunger is released, as when such door 22 is opened in normal operation. Each switch 32, 34, or 36 may be considered as closed, with respect to the fans 30, when in its first mode and as opened, with respect to the fans 30, when in its second mode.

Figure 4:
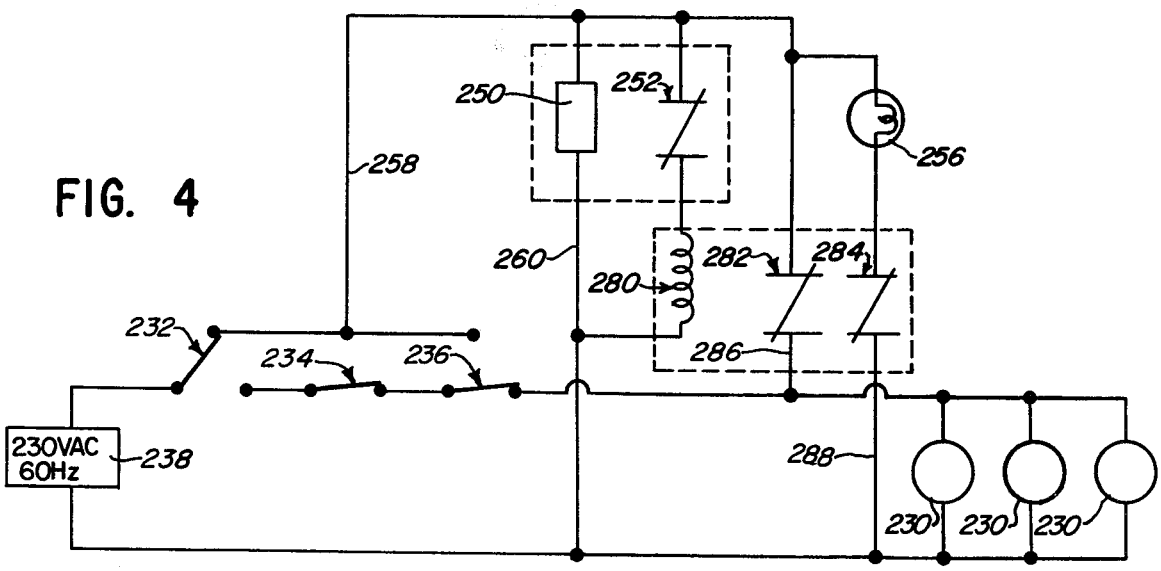
FIG. 4 is a schematic diagram of an alternative embodiment of this invention as may be embodied in a refrigerator as shown in FIG. 1.

In accordance with this invention, the conventional arrangement of FIG. 2 may be replaced either by the preferred embodiment of FIG. 3 or by the alternative embodiment of FIG. 4, in the refrigerator 10 of FIG. 1. The preferred relay of FIG. 5 may be used both in the preferred embodiment of FIG. 3 and in the alternative embodiment of FIG. 4.

As shown diagrammatically, in FIG. 3, a plurality of similar fans 130 are disposed similarly in the cabinet 12 and are operable similarly to force air to circulate within the chamber 20 so as to evaporate excess moisture within the chamber 20, and so as to eliminate stagnant regions within the chamber 20. The fans 130 are connected in parallel (as shown).

As also shown diagrammatically, in FIG. 3, single-throw double-pole switches 132, 134, and 136 are mounted for operation of one such switch with each door 22 so as to switch to a first mode (as the switches 134 and 136 are shown in FIG. 3) when such door 22 is closed, and so as to switch to a second mode (as the switch 132 is shown in FIG. 3) when such door 22 is opened. Also, the switches 132, 134, and 136 are connected so as to enable the fans 130 whenever each one of the switches 132, 134, and 136 is in its first mode, and so as to disable the fans 130—for a delay of preset duration whereupon the fans 130 are enabled through means bypassing the switches 132, 134, and 136 as described below—when any one of the switches 132, 134, and 136 is switched from its first mode to its second mode.

Figure 6:
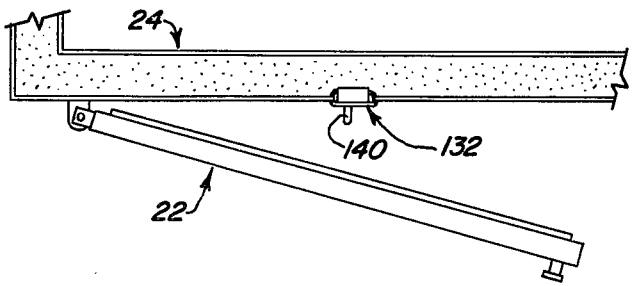
FIG. 6 is a functional representation of a door and a switch mounted to associated framework for operation of the switch with the door, as in the preferred embodiment of FIG. 3, and as in the alternative embodiment of FIG. 4.

As represented functionally in FIG. 6, the switch 132 typifies the switches 132, 134, and 136, and is mounted to the framework 24 for operation of the switch 132 with one of the doors 22, so as to switch to its first mode, wherein a plunger 140 closes one set of its contacts when the same door 22 is closed (downwardly as shown in FIG. 6) and so as to switch to its second mode, wherein the plunger 140 closes another set of its contacts when the same door 22 is opened (upwardly as shown in FIG. 6). An internal spring (not shown) biases the plunger 140 so as to switch the switch 132 to its second mode when the same door 22 is opened.

Constructional details of the switches 132, 134, and 136 are not critical to this invention. Suitable single-throw double-pole switches, which may be used for the switches 132, 134, and 136, are available commercially from Honeywell Inc., Micro Switch Division, Chicago & Springs Sts., Freeport, IL 61032, as Model IDMI 7729 (10A; ⅓ HP;) 125, 250, 277 VAC; U.L. List. L157).

The switches 132, 134, and 136 are connected so as to connect the fans 130 to a conventional source 138 of electrical power (230 VAC, 60 Hz, as shown) when each one of the switches 132, 134, and 136 is in its first mode, and so as to disconnect the fans 130 from the source 138 when any one of the switches 132, 134, and 136 is switched from its first mode to its second mode, except as a parallel circuit between the source 138 and the fans 130 is closed through whichever one of the switches 132, 134, and 136 is in its second mode, as discussed below.

A relay 150, which has a first set 152 and a second set 154 of contacts, that are arranged to be closed after a delay of preset duration from energization of the relay 150 and to be opened upon deenergization of the relay 150, is connected so as to be energized when any one of the switches 132, 134, and 136 is switched from its first mode to its second mode, so as to be deenergized when each one of the switches 132, 134, and 136 is switched from its second mode to its first mode, and so as to enable the fans 130 through the contacts 152 whenever the contacts 152 are closed.

A lamp 156 is connected so as to be energized, through the contacts 154, whenever the contacts 154 are closed, and thus whenever the contacts 152 are closed, as a signal of abnormal operation of the fans 130. A delay of about three minutes may be appropriate, in the refrigerator 10 if used to merchandise frozen foods, dairy products, and other products, so as to allow sufficient time for customers to remove products to be purchased.

As shown diagrammatically in FIG. 3, the relay 150 is connected so as to be energized from the source 138 via a line 158, which is connected to the source 138 through whichever one of the switches 132, 134, and 136 may be in its second mode, and via a line 160. The contacts 152 are connected to the source 138, via a line 162, and to the fans 130, via line 164, so as to complete a parallel circuit between the source 138 and the fans 130 whenever the contacts 152 are closed. The contacts 154 also are connected between the source 138, via the line 162, and the lamp 156, via a line 166, and also are connected to the source 138 via a line 168.

Thus, the fans 130 are energized not only whenever each one of the switches 132, 134, and 136 is switched to its first mode but also whenever the contacts 152 are closed after the delay of preset duration from energization of the relay 150, which is energized when anyone of the switches 132, 134, and 136 is switched from its first mode to its second mode. Thus, the fans 130 are energized at all times except for the delay of preset duration after any one of the switches 132, 134, and 136 is switched from its first mode to its second mode. The lamp 156 is energized through the contacts 154, whenever the fans 130 are energized through the contacts 152, as a signal of abnormal operation of the fans 130.

An alternative arrangement is shown diagrammatically in FIG. 4, in which a plurality of similar fans 230 are disposed similarly in the cabinet 12 and are operable similarly to force air to circulate within the chamber 20 so as to evaporate excess moisture within the chamber 20, and so as to eliminate stagnant regions within the chamber 20. The fans 230 are connected in parallel (as shown).

As also shown diagrammatically in FIG. 4, single-throw double-pole switches 232, 234, and 236, which are similar to the switches 132, 134, and 136 as described above, are mounted for operation of one such switch with each door 22 so as to switch to a first mode (as the switches 234 and 236 are shown in FIG. 4) when such door 22 is closed, and so as to switch to a second mode (as the switch 232 is shown in FIG. 4) when such door 22 is opened. Also, the switches 232, 234, and 236 are connected so as to enable the fans 230 whenever each one of the switches 232, 234, and 236 is in its first mode, and so as to disable the fans 230—for a delay of preset duration whereupon the fans 230 are enabled through means bypassing the switches 232, 234, and 236 as described below—when any one of the switches 232, 234, and 236 is switched from its first mode to its second mode.

The switches 232, 234, and 236 are connected so as to connect the fans 230 to a conventional source 238 of electrical power (230 VAC, 60 Hz, as shown) when each one of the switches 232, 234, and 236 is in its first mode, and so as to disconnect the fans 230 from the source 238 when any one of the switches 232, 234, and 236 is switched from its first mode to its second mode, except as a parallel circuit between the source 238 and the fans 230 is closed through whichever one of the switches 232, 234, and 236 is in its second mode, as described below.

A relay 250, which has a set 252 of contacts that are arranged to be closed after a delay of preset duration from energization of the relay 250, is connected so as to be energized when any one of the switches 232, 234, and 236 is switched from its first mode to its second mode, so as to be deenergized when each one of the switches 232, 234, and 236 is switched from its second mode to its first mode, and so as to enable the fans 230 whenever the contacts 252 are closed.

A lamp 256 is connected so as to be energized, as described below, whenever the contacts 252 are closed, as a signal of abnormal operation of the fans 230. A delay of about three minutes may be appropriate, here also, as discussed above.

As shown diagrammatically in FIG. 3, the relay 250 is connected so as to be energized from the source 238 via a lead 258, which is connected to the source 238 through whichever one of the switches 232, 234, and 236 may be in its second mode, and via a line 260. The contacts 252 are connected between the switches 232, 234, and 236 via the line 258, and a relay 280, which has a first set 282 and a second set 284 of contacts that are arranged to be closed upon energization of the relay 280 and to be opened upon deenergization of the relay 280, and which may be a conventional relay of any suitable type.

The contacts 282 are connected between the switches 232, 234, and 236, via the lead 258, and the fans 230, via a lead 286, so as to complete a parallel circuit between the source 238 and the fans 230 whenever the contacts 282 are closed, and thus whenever the contacts 252 are closed so as to energize the relay 280. The lamp 256 is connected between the source 238, via the line 258, and the contacts 284, which also are connected to the source 238 via a line 288.

Thus, the fans 230 are energized not only whenever each one of the switches 232, 234, and 236 is switched to its first mode but also whenever the contacts 252 are closed after the delay of preset duration from energization of the relay 250, which is energized when any one of the switches 232, 234, and 236 is switched from its first mode to its second mode. Thus, the fans 230 are energized at all times except for the delay of preset duration after any one of the switches 232, 234, and 236 is switched from its first mode to its second mode. The lamp 256 is energized through the contacts 284, whenever the fans 230 are energized through the contacts 282, and thus whenever the contacts 252 are closed, as a signal of abnormal operation of the fans 230.

Figure 5:
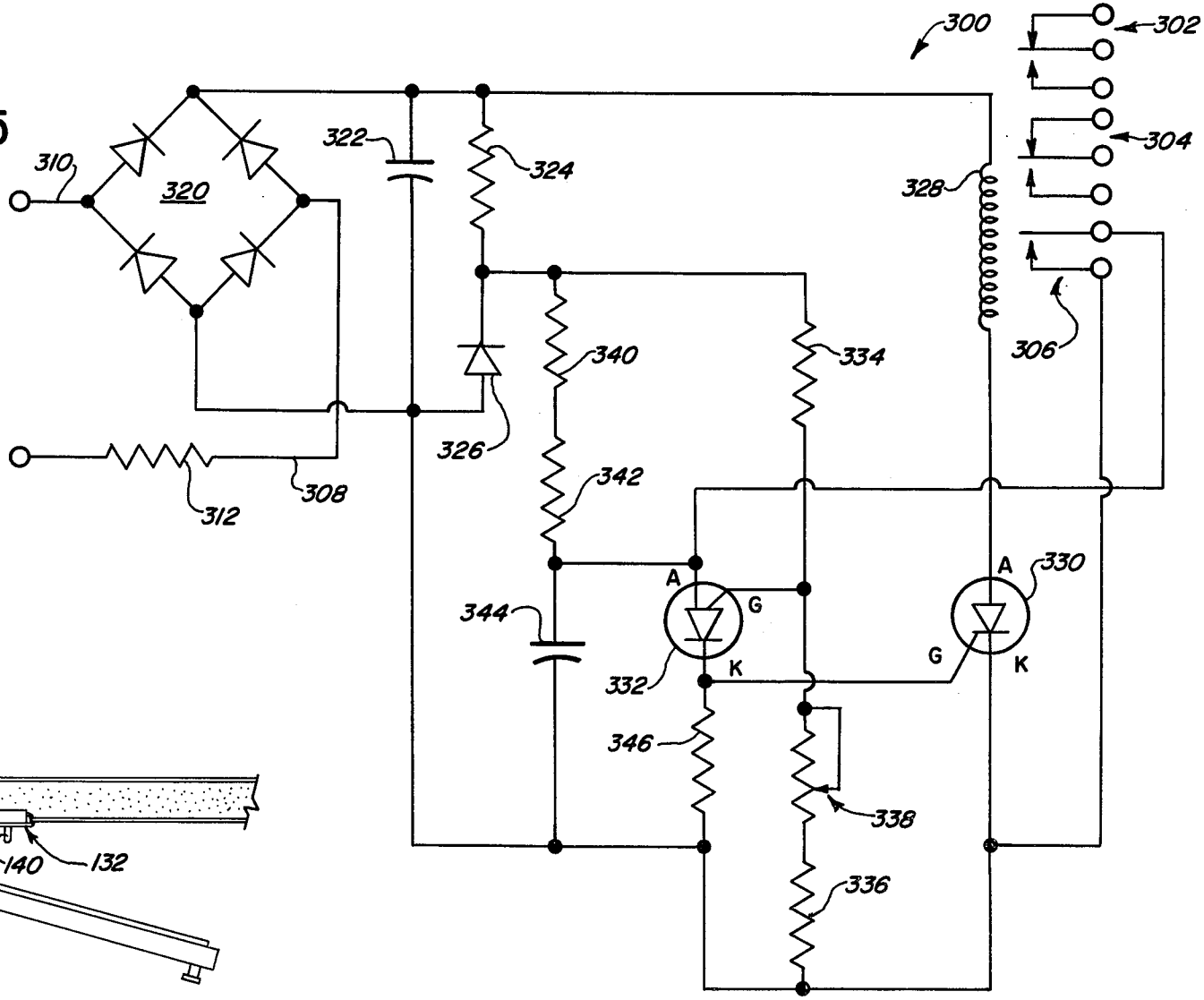
FIG. 5 is a schematic diagram of a preferred relay and its associated contacts to be used both in the preferred embodiment of FIG. 3 and in the alternative embodiment of FIG. 4.

FIG. 5 shows a referred relay 300 that may be used either as the relay 150 of FIG. 3 or as the relay 250 of FIG. 4.

The relay 300 has three sets of contacts, which may be considered as closed as shown. One set 302 corresponds either to the contacts 152 of FIG. 3 or to the contacts 252 of FIG. 4. Another set 304 corresponds to the contacts 154 of FIG. 3. Another set 306 has another function as described below. A line 308 of FIG. 5 corresponds either to the line 158 of FIG. 3 or to the line 258 of FIG. 4. A line 310 of FIG. 5 corresponds either to the line 160 of FIG. 3 or to the line 260 of FIG. 4.

Such a relay is available commercially from Paragon Electric Co., Inc., 606 Parkway Boulevard, Two Rivers, WS 54241, as Paragon Model No. D-900-80. As the Paragon relay is rated for 115 VAC, a suitable resistor 312 is inserted in the line 308, so as to accommodate 230 VAC.

The line 308 and the line 310 lead to a full-wave rectifier 320, whose operation is conventional, and whose output is filtered by a capacitor 322. Voltage regulation is privided, by a resistor 324 and a Zener diode 326, across the capacitor 322. A relay coil 328 is connected to the anode of a silicon-controlled rectifier (SCR) 330. Filtered voltage from the rectifier 320 is applied across the relay coil 328 and the cathode of the SCR 330. When the SCR 330 conducts, the relay coil 328 also conducts, so as to close the contacts 302, 304, and 306.

Trigger current is supplied to the gate of the SCR 330 from a programmable unijunction transistor (PUT) 332, whose parameters are conditioned by a resistor 334, on one side of the gate of the PUT 332, and by a resistor 336 and a trimmer potentiometer 338 in series, on the other side of the gate of the PUT 332. Regulated voltage across the Zener diode 326 is applied across the resistor 334, the resistor 336, and the trimmer potentiometer 338.

Through a resistor 340 and a resistor 342 in series, regulated voltage across the Zener diode 326 allows a capacitor 344 to charge until its voltage equals peak voltage of the PUT 332, whereupon a periodic waveform is produced across a resistor 346 connected to the cathode of the PUT 332. The cathode of the PUT 332 also is connected to the gate of the SCR 330, whereby a first excursion of the periodic waveform triggers the SCR 330.

When the SCR 330 conducts, the relay coil 328 thus conducts, and the contacts 302, 304, and 306 thus are closed. Also, the capacitor 344 is shunted, through the contacts 306, so as to prevent further excursions of the periodic waveform. The SCR 330 remains conductive so long as rectified voltage is applied.

Further information on such circuits as are found in the relay 300 is not critical to this invention and may be found in standard references including Kaufman & Seidman, *Handbook for Electronics Engineering Technicians* (McGraw-Hill 1976) wherein sections 8.7 and 8.9 discuss silicon-controlled rectifiers and programmable unijunction transistors respectively.

By way of example, suitable elements for the relay 300 may be specified as follows: resistor 312, 10 Kohms, rated at 5 watts; each diode of full-wave rectifier 320, type 1N4003; capacitor 322, 3 microfarads, 250 volts DC working voltage; resistor 324, 27 Kohms, rated at 1 watt; Zener diode 326, Zener voltage of 12 volts, rated at 400 milliwatts; coil 328, Potter & Brumfield type KU14D37-110; SCR 330, General Electric type C103B; PUT 332, General Electric type 2N6027; resistor 334, 120 Kohms, rated at 0.25 watt; resistor 336, 120 Kohms, rated at 0.25 watt; trimmer potentiometer, 2 Mohms; resistor 340, 18 Kohms, rated at 0.25 watt; resistor 342, 700 Kohms, rated at 0.25 watt; capacitor 344, 10 microfarads, 25 volts DC working voltage; and resistor 346, 10 Kohms, rated at 0.25 watt. Such values are approximate.

The embodiments described above are intended to be exemplary but not to limit this invention wherein various modifications, variations, and changes are possible. As an example, a thermal relay of a type having a bimetallic armature, which closes contacts after a delay of preset duration from energization of a heater, is expected to be adaptable to other embodiments of this invention.

We claim:

1. In a refrigerator of a type comprising a cabinet, means to refrigerate contents of a chamber within said cabinet, a door mounted to said cabinet for access to said chamber, a fan disposed in said cabinet and operable to force air to circulate within said chamber, and a switch mounted for operation of said switch with said door so as to switch to a first mode wherein said switch enables said fan when said door is closed and so as to switch to a second mode wherein said switch disables said fan when said door is opened, an improvement wherein a relay, of a type having a set of contacts arranged to be closed after a delay of preset duration from energization of said relay and to be opened upon deenergization of said relay, is connected so as to be energized in the second mode of said switch, so as to be deenergized in the first mode of said switch, and so as to enable said fan whenever said contacts are closed.

2. The improvement of claim 1, in a refrigerator of said type comprising a plurality of switches mounted similarly, switchable to similar modes, and connected so as to enable said fan when each one of said switches is switched to its first mode and so as to disable said fan when any one of said switches is switched to its second mode, wherein said relay is connected so as to be energized through any one of said switches when said one of said switches is switched to its second mode and so as to be deenergized when each one of said switches is switched to its first mode.

3. The improvement of claim 1, in a refrigerator of said type comprising a plurality of doors mounted to said cabinet for access to said space and a plurality of switches mounted for operation of at least one of said switches with each of said doors, switchable to similar modes, and connected so as to enable said fan when each one of said switches is switched to its first mode and so as to disable said fan when any one of said switches is switched to its second mode, wherein said relay is connected so as to be energized by any one of said switches when said one of said switches is switched to its second mode and so as to be deenergized when each one of said switches is switched to its first mode.

4. The improvement of claim 1, in a refrigerator of said type comprising a plurality of doors mounted to said cabinet for access to said chamber, a plurality of fans disposed in said cabinet and operable to force air to circulate within said chamber, and a plurality of switches mounted for operation of at least one of said switches with each of said doors, switchable to similar modes, and connected so as to enable said fans when each one of said switches is switched to its first mode and so as to disable said fans when any one of said switches is switched to its second mode, wherein said relay is connected so as to be energized when said one of said switches is switched to its second mode, and so as to be deenergized when each one of said switches is switched to its first mode.

5. The improvement of claim 1 wherein a lamp is connected so as to be energized when said contacts are closed for energization of said fan.

6. The improvement of claim 5 wherein said lamp is connected so as to be energized through another set of contacts arranged to be closed after said delay of preset duration from energization of said relay and so as to be opened upon deenergization of said relay.

7. The improvement of claim 1 wherein said relay is a first relay and a second relay, of a type having contacts arranged to be closed upon energization of said second relay and to be opened upon deenergization of said second relay, is connected so as to be energized through said contacts of said first relay and so as to bypass said switch for energization of said fan through said contacts of said second relay.

8. The improvement of claim 7 wherein a lamp is connected so as to be energized through another set of contacts arranged to be closed upon energization of said second relay and to be opened upon deenergization of said second relay.

* * * * *